US006443820B2

(12) United States Patent
Kimura

(10) Patent No.: US 6,443,820 B2
(45) Date of Patent: Sep. 3, 2002

(54) POLISHING APPARATUS

(75) Inventor: Norio Kimura, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/840,074

(22) Filed: Apr. 24, 2001

(30) Foreign Application Priority Data

Apr. 25, 2000 (JP) ..... 2000-123891

(51) Int. Cl.[7] ..... B24B 5/00
(52) U.S. Cl. ..... 451/285; 451/397; 451/398
(58) Field of Search ..... 451/41, 285–287, 451/288, 397, 398, 402

(56) References Cited

U.S. PATENT DOCUMENTS

| | | | | |
|---|---|---|---|---|
| 5,624,299 A | | 4/1997 | Shendon | |
| 6,012,964 A | * | 1/2000 | Arai et al. | 451/5 |
| 6,056,632 A | | 5/2000 | Mitchel et al. | |
| 6,277,009 B1 | | 8/2001 | Chen et al. | |
| 6,280,306 B1 | * | 8/2001 | Hosoki et al. | 451/288 |
| 6,368,189 B1 | * | 4/2002 | Maloney et al. | 451/41 |

FOREIGN PATENT DOCUMENTS

| | | |
|---|---|---|
| EP | 1048408 | 11/2000 |

* cited by examiner

*Primary Examiner*—Eileen P. Morgan
(74) *Attorney, Agent, or Firm*—Wenderoth, Lind & Ponack, L.L.P.

(57) ABSTRACT

A polishing apparatus for polishing a plate-like workpiece by way of a relative sliding motion between the plate-like workpiece and a polishing surface. The polishing apparatus comprises a carrier for holding the plate-like workpiece. The carrier comprises a carrier body having a flat surface and one or more recesses formed in the carrier body surface, an inner sheet covering the carrier body surface and having an outer peripheral edge sealingly connected to the carrier body, an outer sheet covering the inner sheet and having an outer peripheral edge sealingly connected to the carrier body, and a pressure supply device for providing selectively a negative pressure or a positive pressure between the inner sheet and the carrier body surface so that, upon provision of the negative pressure, a suction force is created on the outer surface of the outer sheet to draw a workpiece against the outer sheet and, when applied the positive pressureacts on the workpiece through the inner and outer sheets to press the workpiece against the polishing surface.

10 Claims, 6 Drawing Sheets

POLISHING APPARATUS

BACKGROUND OF THE INVENTION

The present invention relates to a polishing apparatus for polishing a plate-like article such as a semiconductor wafer or an optical lens.

In manufacturing integrated circuits, optical devices and the like, it is important that a workpiece used to form an integrated circuit, optical device or the like have a highly planar surface. Recently, a polishing technique referred to as "Chemical Mechanical Polishing (CMP)" has been commonly employed in polishing semiconductor wafers. In Chemical Mechanical Polishing, a semiconductor wafer held by a rotating carrier body is brought into contact with a polishing surface provided on a rotating turntable while an alkali or acid abrasive slurry is supplied onto the polishing surface, whereby the wafer is polished both mechanically under relative motion between the rotating carrier body and the rotating turntable, and chemically by the supplied slurry. In this way, the wafer surface can be polished to an exceptionally high degree of flatness. However, it is important that the surface of the carrier body which is used to hold and press the wafer against the turntable polishing surface also be uniformly flat, and that a force applied in pressing the wafer against the polishing surface be applied across the surface of the wafer uniformly. It has been difficult to meet this requirement.

One method which has been developed involves covering the surface of a carrier body with a resilient membrane and forming a pressurized fluid chamber between the inner membrane surface and the carrier body surface. In a polishing operation, a wafer held on the outer surface of the membrane is pressed against the polishing surface under a fluid pressure supplied into the fluid chamber to impart a uniform pressure across the wafer surface. To hold the wafer on the membrane surface during transfer to and from the polishing surface, a negative pressure is generated between the wafer and the membrane by making the latter surface concave. However, this method is subject to a problem that when a negative pressure acts on a wafer causing it to bend, if even minute defects exist on the wafer's surface, the wafer may break. A solution to this problem has been desired.

SUMMARY OF THE INVENTION

The object of the present invention is to provide a polishing apparatus in which a workpiece such as a semiconductor wafer or the like is securely held on a carrier body surface under a suction force. This suction force is applied during transfer of the workpiece to and from a polishing surface, and when it is brought into contact with the polishing surface a positive pressure is provided which acts across the surface of the workpiece uniformly, whereby a high degree of flatness of the workpiece surface can be attained.

According to one aspect of the present invention, a polishing apparatus comprises a carrier for holding a plate-like workpiece and bringing it into contact with a polishing surface. The carrier comprises a carrier body having a flat surface and one or more recesses formed in the carrier body surface, a non-porous inner sheet provided adjacent to the carrier body surface and covering it, an outer sheet covering the inner sheet, with openings extending from the inner to outer surface of the outer sheet, and a pressure supply device for generating selectively a negative or positive pressure between the inner sheet and the carrier body surface. The inner and outer sheets are sealingly connected to the carrier body along their outer peripheral edges. When a negative pressure is generated between the inner sheet and the carrier body surface, a suction force acts on the outer surface of the outer sheet to draw a workpiece against it. If a positive pressure is provided, it acts on the workpiece through the inner and outer sheets and presses it against the polishing surface.

Since the inner sheet is made of a flexible material and the outer sheet of a relatively rigid material, when a negative pressure is provided, it causes a portion of the inner sheet to deform, and this deformed portion enters the recesses in the carrier body surface, with the result that spaces are formed between the deformed portions of the inner sheet and the outer sheet. In these spaces, a secondary negative pressure is generated and transferred through the openings formed in the outer sheet to the outer surface of the outer sheet to draw a workpiece against this outer surface. In contrast, if a positive pressure is provided, it acts to urge the inner sheet against the outer sheet thereby pressing a workpiece held on the outer surface of the outer sheet against the polishing surface.

The polishing apparatus further includes a negative pressure or vacuum supply device adapted to be fluidly communicated with the spaces formed between the deformed portions of the inner sheet and the outer sheet. Specifically, the carrier body is provided with a circumferential surface extending from the carrier body surface at a predetermined angle in a direction away from the polishing surface when the carrier is positioned for polishing a workpiece, and the circumferential surface is provided with a passage having one end adapted to be connected to the negative pressure supply device and the other end fluidly connected to the recesses formed in the carrier body surface. The negative pressure provided by the negative pressure supply device enables the workpiece to be held securely against the outer sheet.

Further, a pressure ring is provided around the carrier in such a manner as to be able to move vertically independently of the carrier to press against the polishing surface. Preferably, the pressure ring depresses the polishing surface to the same level as that of an area of a workpiece to be polished to avoid an excessive force being imposed on the edge of workpiece when the rotating polishing surface comes into contact with the rotating workpiece.

These and other features and advantages of the present invention will become apparent from the following detailed description of the invention when taken in conjunction with the accompanying drawings wherein like reference numerals designate like or corresponding elements throughout the several views.

DETAILED DESCRIPTION OF THE INVENTION

Figure 1:
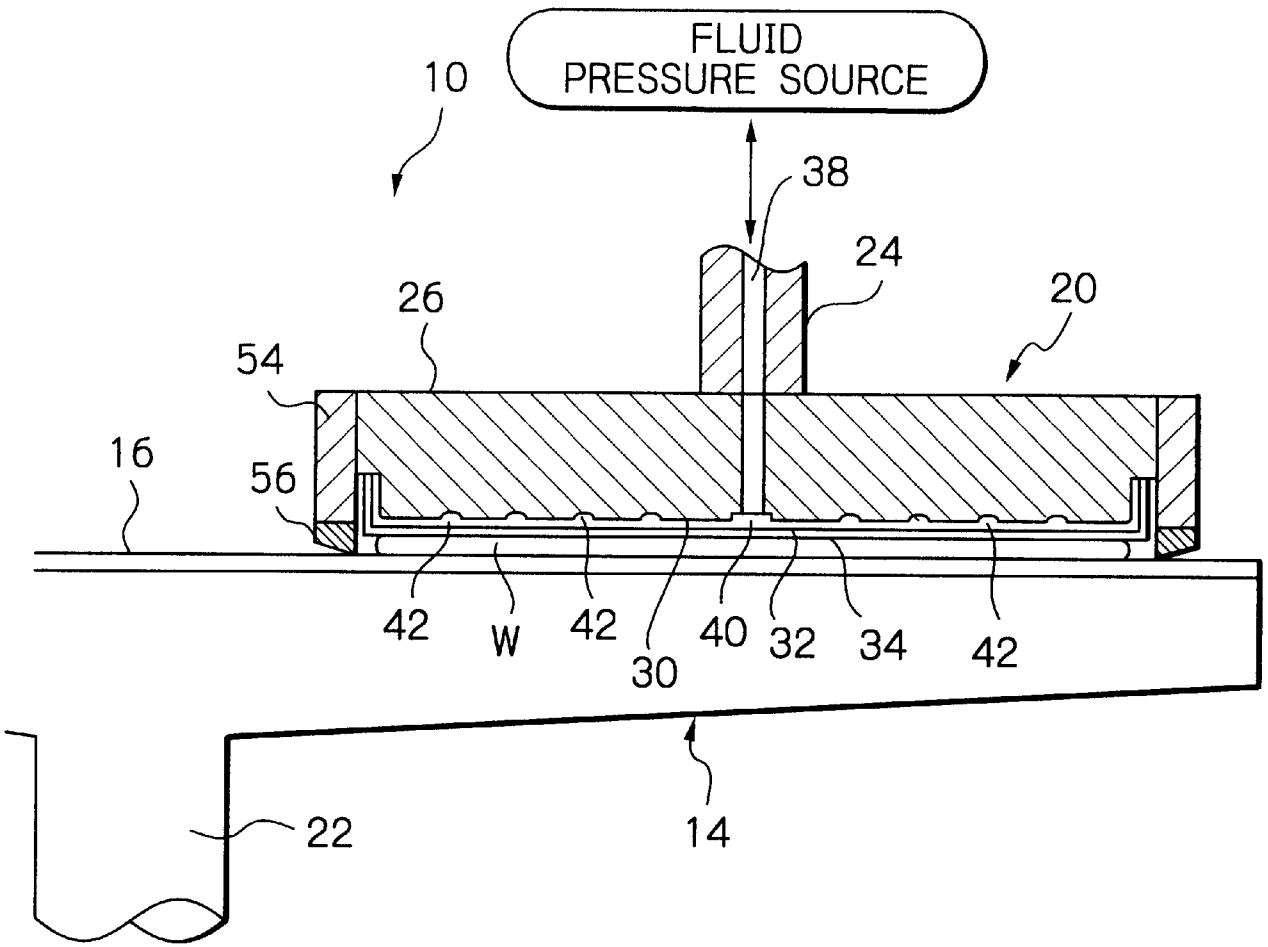
FIG. 1 is a sectional view of a main part of a polishing apparatus in accordance with the present invention.

With reference to the drawings, embodiments of the present invention will be explained below. FIGS. 1–6 show one embodiment of the present invention. In this embodiment, a polishing apparatus 10 is used for polishing semiconductor wafers W and includes, as shown, a turntable 14 and a wafer carrier 20 for holding the semiconductor wafer W and pressing the wafer against a polishing pad 16 provided on an upper surface of the turntable 14.

In a polishing operation, the turntable 14 and the wafer carrier 20 are rotated by drive shafts 22 and 24 respectively whereby a sliding motion occurs between the wafer W and the polishing pad 16, with an alkali abrasive slurry being supplied by a nozzle (not shown) onto the polishing pad 16, thereby conducting chemical mechanical polishing of the semiconductor wafer.

The wafer carrier comprises, as shown in FIG. 1, a disk-like carrier body 26 drivingly connected to the drive shaft 24, a flexible non-porous inner sheet 32 configured to be substantially in contact with and cover an entire area of a carrier body surface or lower surface of the carrier body 26 facing the turntable 14, and a flexible porous outer sheet 34 configured to be substantially in contact with and cover an entire area of the inner sheet 32.

Figure 2:
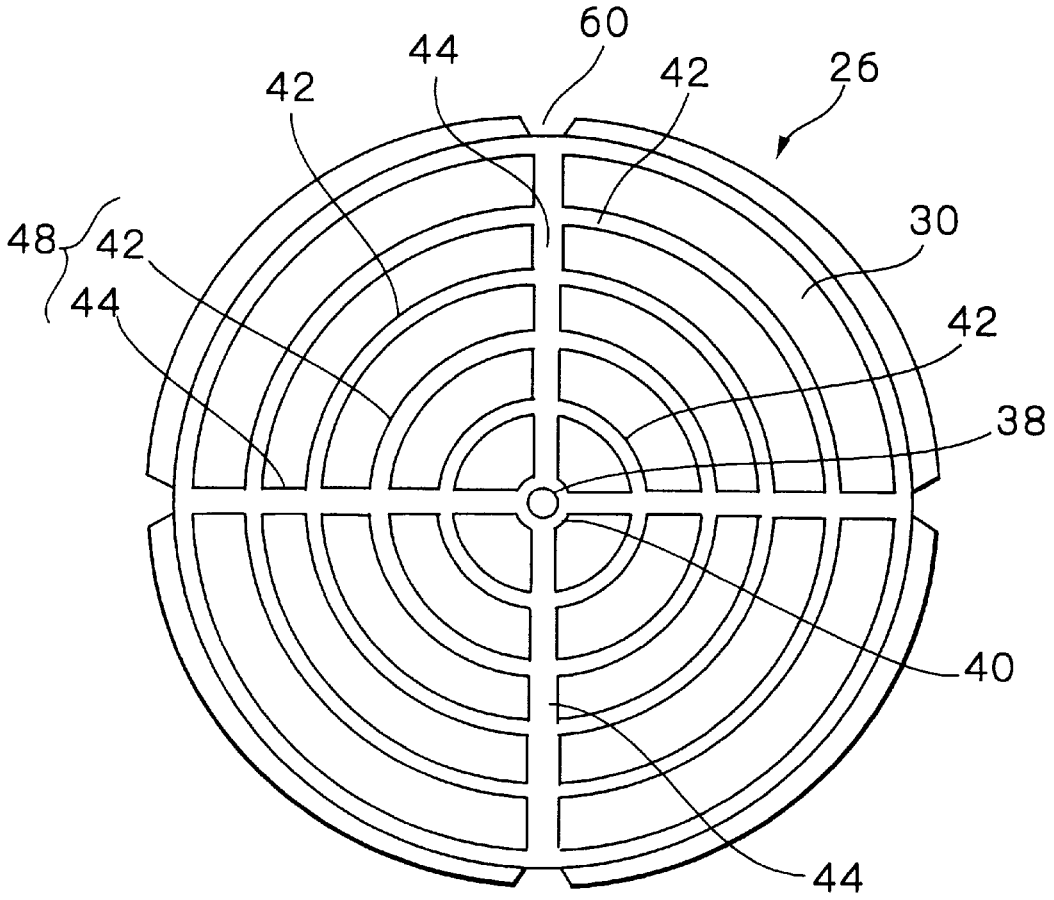
FIG. 2 is a bottom view of a carrier body of the polishing apparatus of FIG. 1.
Figure 3:
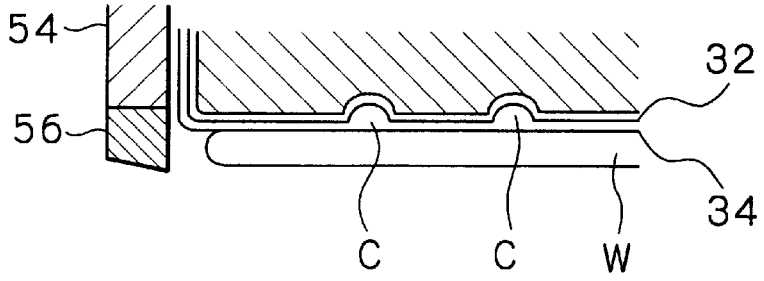
FIG. 3 is a cross-sectional view of a part of the polishing apparatus of FIG. 1 showing a relationship between inner and outer sheets of the polishing apparatus and a semiconductor wafer.

The rotational drive shaft 24 and the carrier body 26 are provided with a fluid passage 38 having one end opening formed in the carrier body surface 30 and the other end fluidly connected to a fluid pressure source (not shown). As shown in FIGS. 1 and 2, the wafer carrier body surface 30 has a center circular recess 40 provided at the center thereof and fluidly communicated with the fluid passage 38, five concentric annular recesses or grooves 42 which are concentric with the center circular recess 40 and spaced away from each other, and four straight radial recesses 44 extending at ninety degree intervals from the center circular recess 40 to fluidly connect the center circular recess 40 with the annular recesses 42.

In accordance with the embodiment, the carrier body 26 is fixedly provided on its circumferential surface with a retainer ring holder 54 to hold a retainer ring 56 at its lower end in order to prevent the semiconductor wafer W being displaced from the carrier. The outer peripheral portions of the inner and outer sheets 32, 34 are clamped between the circumferential surface of the carrier body 26 and the retainer ring holder 54 to fasten the inner and outer sheets 32, 34 to the carrier body 26.

Figure 4:
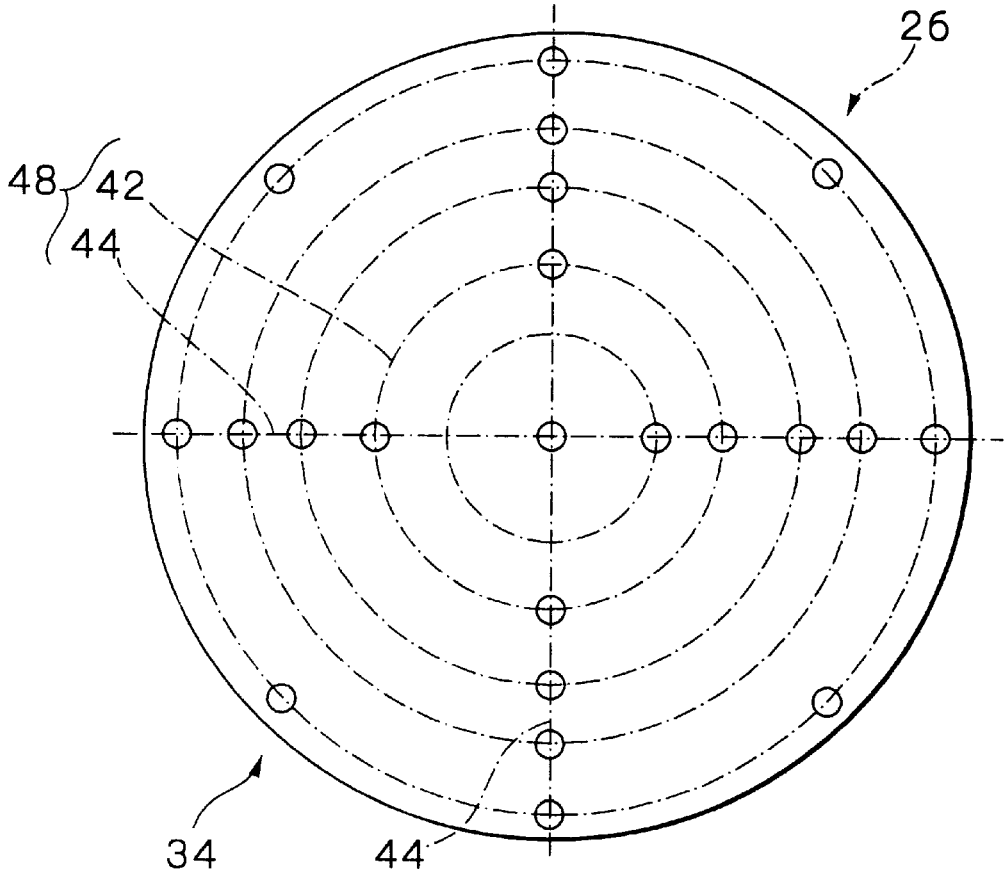
FIG. 4 is a bottom view of the outer sheet.

To hold a semiconductor wafer W on the wafer carrier 20 for transferring the wafer W onto the polishing pad 16 of the turntable for polishing of the wafer or to transfer or remove the same from the polishing pad after the polishing, a vacuum is applied to a space between the wafer carrier body surface 30 and the inner sheet 32 from a vacuum source (not shown) through the fluid passage 38 and the recesses formed in the wafer carrier body surface including the central circular recess 38, the annular recesses 42 and the straight radial recesses 44. As a consequence, the inner sheet 32 is drawn against the wafer carrier body surface 30 so that the recesses 38, 42, 44 draw portions of the inner sheet 32 corresponding to those recesses thereinto, thereby forming spaces c between the drawn portions of the inner sheet 32 and the outer sheet 34. A negative pressure is thus generated in the spaces c, and transferred to the outer surface of the outer sheet 34 through pores in the sheet member 34 to create a suction force to draw the semiconductor wafer W against the outer surface of the outer sheet 34. The porous outer sheet 34 may be replaced with a non-porous sheet member provided with a plurality of, for example, as shown in FIG. 4, twenty through-holes spaced apart from each other and provided along the recesses 44 in the wafer carrier body surface 30.

Figure 6:
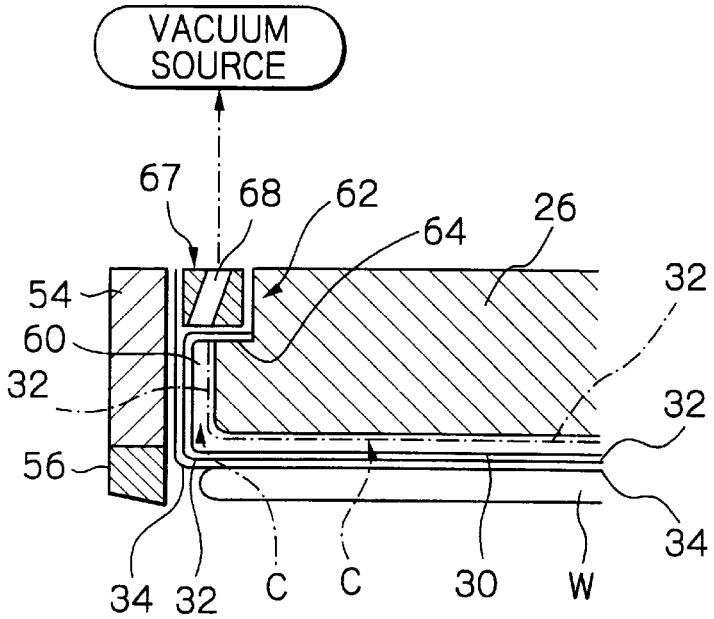
FIG. 6 is a cross-sectional view of a part showing peripheral edge portions of the inner and outer sheets and a vacuum passage for applying a vacuum between the inner and outer sheets.

In this case, it is desirable to apply a vacuum to spaces c formed between the inner and outer sheets 32, 34. To this end, as shown in FIGS. 2 and 6, the carrier body 26 is provided on its outer circumferential surface with fluid passages 60 at ninety degree intervals fluidly connected to the corresponding radial recesses 44 formed in the wafer carrier body surface 30. As best shown in FIG. 6, the carrier body 26 is provided along its upper peripheral edge with a stepped recess portion 62 with the vertical passage 60 fluidly connected to the stepped recess portion 62. The inner and outer sheets 32, 34 are bent upwardly at the lower peripheral edge of the carrier body 26 and extend upward along the circumferential surface of the carrier body 26. The peripheral edge portion of the inner sheet 32 is further bent radially inwardly at the stepped recess portion 62 to extend onto the surface of the stepped recess portion 62, while the peripheral edge portion of the outer sheet 34 is not bent at the stepped recessed portion and extends upwards. A sheet retaining ring 67 is securely fitted in the stepped recess portion so that the sheet retaining ring 67 fastens the peripheral edge portion of the inner sheet 32 between the sheet retaining ring 67 and the wafer carrier body 26 and the circumferential edge portion of the outer sheet 34 between the sheet retaining ring 67 and the retainer ring 54. The sheet retaining ring is formed with a passage 68 extending in a vertical direction. The upper end of the passage 68 is adapted to be connected to a vacuum source 66 and the lower end of the same is aligned with one of the vertical passages 60 formed in the circumferential surface of the carrier body 26. As stated above, when a vacuum is applied to the passage 38 in the rotational drive shaft 24, the negative pressure spaces c are formed between the inner and outer sheets 32, 34 along the recesses 38, 42 and 44 and thus along the vertical recesses 60, a vacuum is also applied to the space c formed along the vertical passage 60 through the passage 68 formed in the sheet retaining member 67. The vacuum is within a range from −50 Kpa to −90 Kpa.

Figure 5:
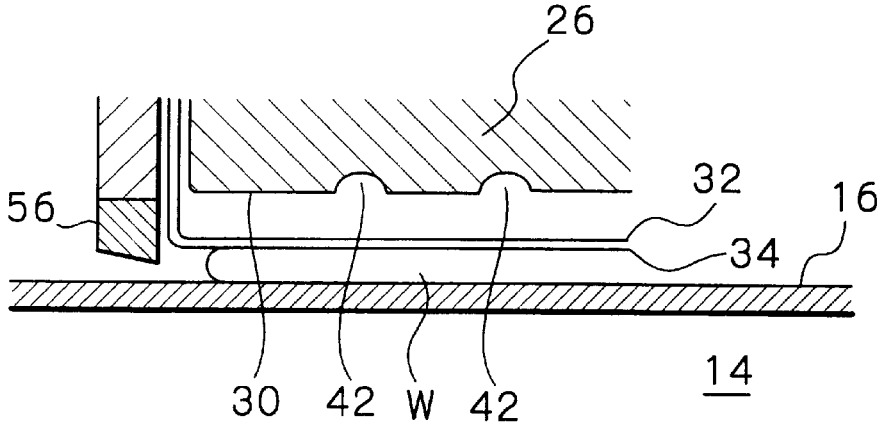
FIG. 5 is a cross-sectional view of a part of the polishing apparatus showing a relationship between the inner and outer sheets and a wafer during polishing of the wafer.

In a polishing operation, instead of a vacuum, a pressurized fluid is supplied from the fluid pressure source to a space between the wafer carrier body surface 30 of the wafer carrier body 26 and the inner sheet 32 so that, as shown in FIG. 5, the inner sheet 32 is urged against the outer sheet 34. As a consequence, the wafer W held by the carrier 20 is uniformly pressed against the polishing pad 16 under a force imposed by the pressurized fluid through the inner and outer sheets 32, 34. The pressure is preferably within a range from 4.9 Kpa~49 Kpa (50~5000 g/cm$^2$.

The inner sheet 32 is preferably made of an flexible material so that, when a vacuum is applied as stated above, the inner sheet 32 is easily deformed into the recesses 38, 42, 44, 60 formed on the wafer carrier body 26. Specifically, as a material of the inner sheet 32, polyurethane or latex, for example, may be used. In contrast, the outer sheet 34 is preferably made of a relatively rigid material so that, even if the inner sheet 32 is deformed as stated above, the outer sheet 34 does not follow the deformation of the inner sheet 32 to form the spaces c between the inner and outer sheets. Specifically, as a material of the outer sheet, neprane rubber, silicon gum, urethane rubber, or fluoro rubber, for example, may be used. In order to enable the outer sheet 34 to, as shown in FIG. 6, expand towards the wafer held by the wafer carrier, the outer sheet 34 may be provided in its circumferential surface with pleats or the like.

Figure 7:
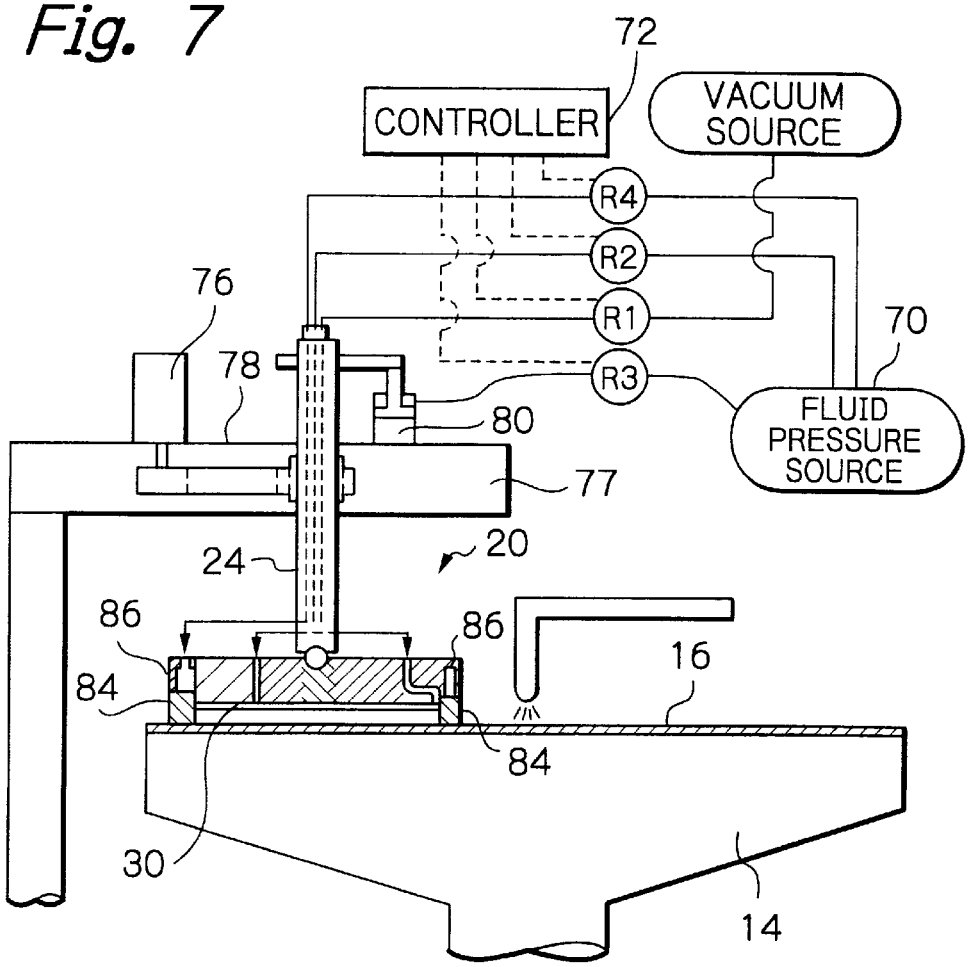
FIG. 7 is a schematic view of a polishing apparatus in accordance with another embodiment of the present invention.
Figure 8:
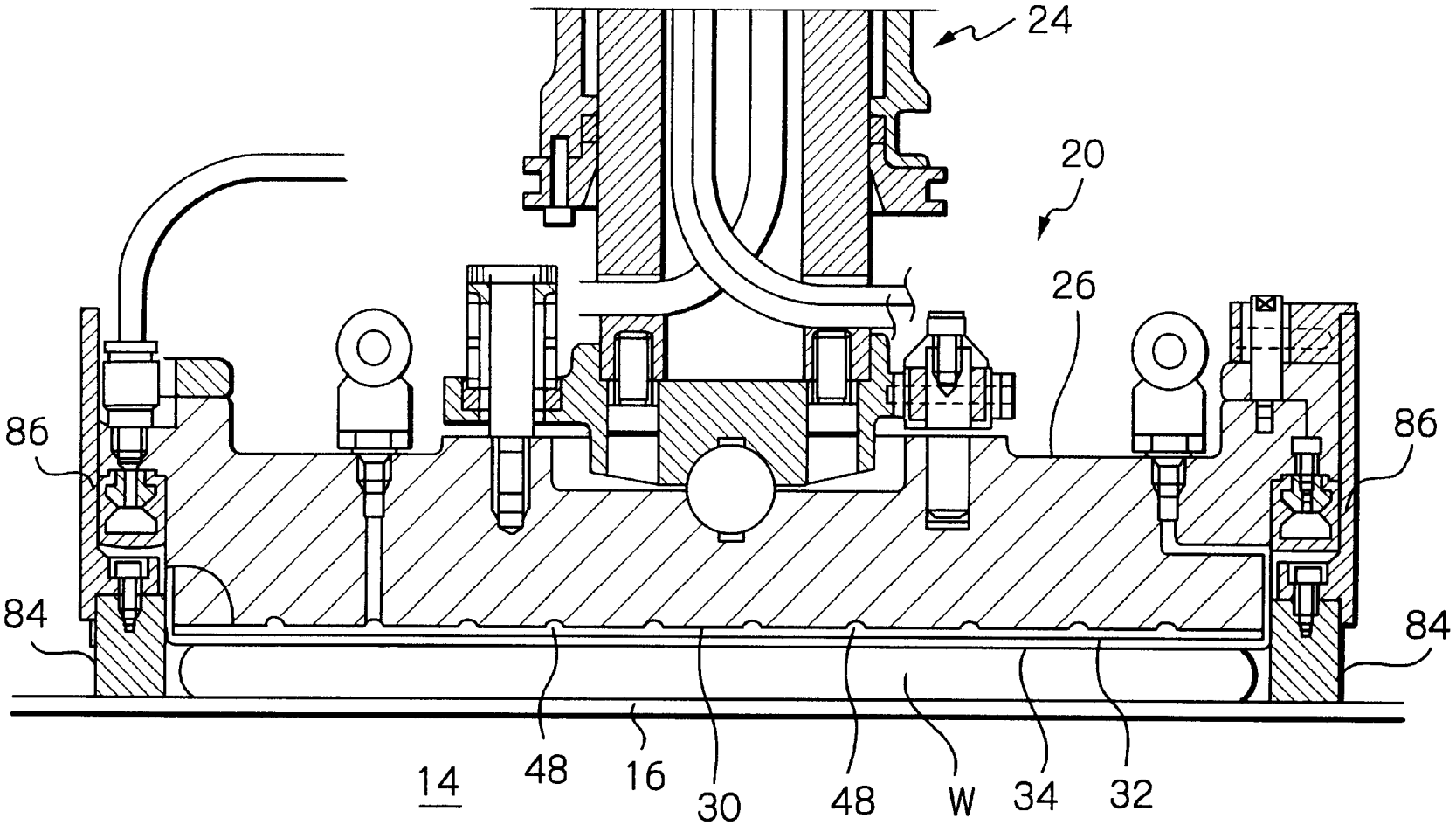
FIG. 8 is an enlarge cross-sectional view of a main part of the polishing apparatus of FIG. 7.

FIG. 7 is a schematic view of a whole polishing apparatus in accordance with another embodiment of the present invention and FIG. 8 is a longitudinal cross sectional view of a main part of the polishing apparatus.

The polishing apparatus is basically the same as that of the afore-mentioned embodiment and comprises a turntable 14 provided with a polishing pad 16, and a wafer carrier 20 having a wafer carrier body surface 30 facing the polishing pad 14 of the turntable. The wafer carrier 20 further includes a non-porous inner sheet 32 provided over the wafer carrier body surface 30 and a porous outer sheet 34 provided outside and adjacent to the inner sheet 32 to cover the same. As shown, the polishing apparatus includes a fluid pressure source 70 for providing a desired fluid pressure between the wafer carrier body surface 30 and the inner sheet 32. Specifically, the fluid pressure source 70 is adapted to apply a vacuum between the wafer carrier body surface 30 and the inner sheet 32. The vacuum draws the inner sheet 32 against the wafer carrier body surface 30 so that the inner sheet 32 is subject to a partial deformation into recesses 48 formed in the wafer carrier body surface to form spaces, corresponding to the spaces c referred to in the first embodiment, between the deformed portions of the inner sheet 32 and the outer sheet 34. As a consequence, a negative pressure is created in the spaces and transferred to the outer surface of the outer sheet 34 through pores in the outer sheet 34 to draw a wafer W against the outer surface of the outer sheet 34. In this case, the spaces c may be subjected to a vacuum of a vacuum source through a valve R1 to securely draw the wafer W against the outer sheet 34. Further, the fluid pressure source 70 is adapted to supply a pressurized fluid between the wafer carrier body surface 30 and the inner sheet 32. The pressurized fluid expands the inner sheet 32 and, thus, the outer sheet 34 to thereby press the wafer W on the outer surface of the outer sheet 34 against the polishing pad 16 of the turntable 14. The inner and the outer sheets 32, 34 are fastened to the wafer carrier in the same way as that in the afore-mentioned embodiment. In FIG. 7, reference numeral 76 designates a motor mounted on a carrier body 77 and adapted to drive a rotational drive shaft 24 of the wafer carrier through a belt drive device 78. Reference numeral 80 designates an actuator mounted on the carrier body 77 and adapted to move the wafer carrier 20 and the rotational drive shaft 24 vertically.

This polishing apparatus is different from that of the afore-mentioned embodiment in that a pressure ring 84 for carrier body the surface polishing pad 16 is provided in place of the retainer ring 56 which is securely provided on the wafer carrier body 26, the pressure ring 84 being movable vertically independently of the wafer carrier body 26. The pressure ring 84 is provided in the carrier body 26 and is adapted to be subjected to a downward pressing force by a bellows-type expansion member 86 which is supplied with a pressurized fluid from the fluid pressure source 70. When the wafer W is polished under a relative motion between the wafer held by the wafer carrier and the polishing pad, the pressure ring 84 presses down the surface of the polishing pad 16 around the wafer in order to avoid excess friction which would otherwise be exerted on the edge of the wafer by the polishing pad.

Figure 9:
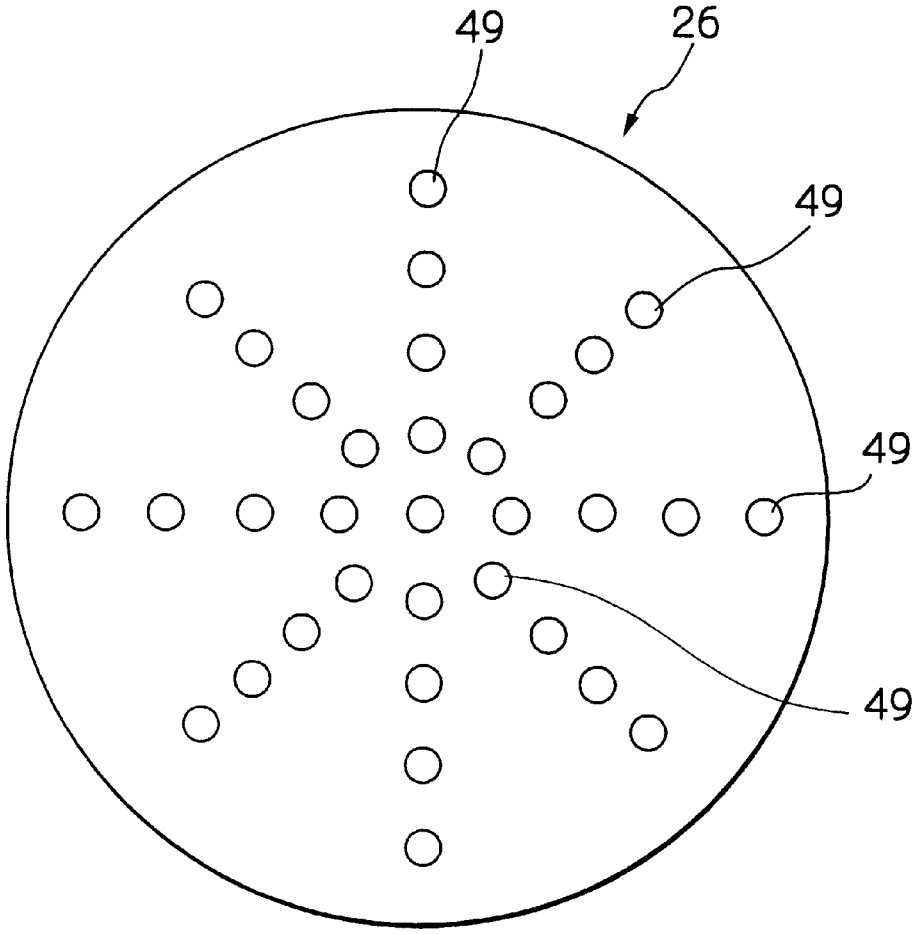
FIG. 9 is a bottom view of a carrier body in accordance with a further embodiment of the present invention.
Figure 10:
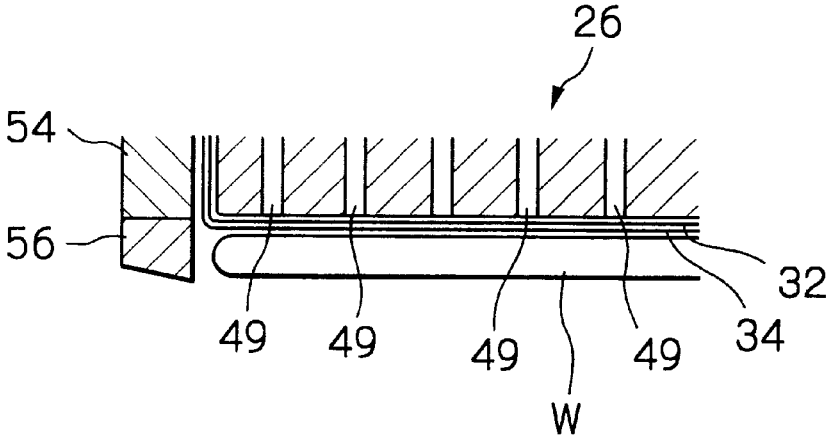
FIG. 10 is a cross-sectional view of a part of the carrier body provided with inner and outer sheets covering the bottom surface of the carrier body showing a relationship between the inner and outer sheets and a wafer during polishing of the wafer.

FIGS. 8 and 9 show a carrier body 26 in accordance with a further embodiment of the present invention. As shown, the carrier body 26 is provided with a plurality of through holes 49 each having an upper end opening which is adapted to be connected to a fluid pressure source and a lower end opening facing an inner sheet 32 provided over the bottom surface of the carrier body 26. In this embodiment, the inner sheet 32 and outer sheet 34 are formed of flexible non-porous material and the outer sheet 34 is provided with a plurality of holes as in the outer sheet 34 shown in FIG. 4 which holes are aligned with the lower end openings of the through holes 41 of the carrier body 26. In this embodiment, the lower end openings of the through holes 49 perform the same function as that of the recesses 38, 42, 44 in the first embodiment in operation.

In accordance with the present invention, a semiconductor wafer or workpiece is subjected to a fluid pressure which is uniform across the entire surface of the workpiece, whereby it is pressed against the polishing pad through the inner and outer sheets 32, 34 thereby enhancing uniformity of polishing of the workpiece. Further, when a workpiece is held on the carrier 20 for transfer thereof, the workpiece is drawn by a suction force applied through the outer sheet 34 against the surface 30 of the carrier body 26 which is generally flat, whereby the workpiece is prevented from becoming curved under a suction force and, as a consequence, breakage of the workpiece, which was liable to occur in the prior art, is prevented.

It is to be understood that the apparatuses described above are only exemplary and do not limit the scope of the invention, and that various modifications can be made by those skilled in the art that would fall under the scope of the invention.

What is claimed is:

1. A polishing apparatus for polishing a plate-like workpiece by a relative sliding motion between the workpiece and a polishing surface, the polishing apparatus comprising a carrier for holding the workpiece to bring the workpiece into contact with the polishing surface, the carrier comprising:

a carrier body having a carrier surface and one or more recesses or openings formed in the carrier body surface;

an inner sheet positioned adjacent to the surface of the carrier body and covering the carrier body surface, the inner sheet being non-porous and having an outer peripheral edge sealingly connected to the carrier body;

an outer sheet positioned adjacent to and covering the inner sheet, the outer sheet having openings extending from an inner surface of the outer sheet to an outer surface of the same, and an outer peripheral edge sealingly connected to the carrier body; and a pressure supply device for providing a negative pressure between the inner sheet and the carrier body surface so that a suction force is created on the outer surface of the outer sheet to draw a workpiece against the outer sheet.

2. A polishing apparatus as set forth in claim 1, in which said pressure supply device is capable of providing a positive pressure between the inner sheet and the carrier body surface so that it acts the workpiece through the inner and outer sheets to press the workpiece against the polishing surface.

3. A polishing apparatus as set forth in claim 2, in which the inner sheet is made of a flexible material and the outer sheet is made of a relatively rigid material so that, upon provision of the negative pressure between the carrier body surface and the inner sheet, the inner sheet is partially deformed into the recesses or the openings in the carrier body surface to form spaces between the deformed portions of the inner sheet and the outer sheet in which spaces a secondary negative pressure is generated, the secondary negative pressure being transferred through the openings formed in the outer sheet to the outer surface of the outer sheet thereby drawing a workpiece against the outer surface of the outer sheet, while, upon provision of the positive pressure, the inner sheet is urged against the outer sheet by the positive pressure to press a workpiece held on the outer surface of the outer sheet against the polishing surface.

4. A polishing apparatus as set forth in claim 1, further including a negative pressure supply device adapted to be fluidly communicated with the spaces formed between the deformed portions of the inner sheet and the outer sheet.

5. A polishing apparatus as-set forth in claim 2, further including a negative pressure supply device adapted to be fluidly communicated with the spaces formed between the deformed portions of the inner sheet and the outer sheet.

6. A polishing apparatus as set forth in claim 2 further comprising a pressure ring provided around the carrier body in such a manner that the pressure ring can move vertically independently of the carrier body to independently press the polishing surface.

7. A polishing apparatus as set forth in claim 3 further comprising a pressure ring provided around the carrier body in such a manner that the pressure ring can move vertically independently of the carrier body to independently press the polishing surface.

8. A polishing apparatus as set forth in claim 4 further comprising a pressure ring provided around the carrier body in such a manner that the pressure ring can move vertically independently of the carrier body to independently press the polishing surface.

9. A polishing apparatus as set forth in claim 4 in which the carrier body has a circumferential surface extending from the carrier body surface at a predetermined angle in a direction away from the polishing surface and the circumferential surface is provided with a passage having one end adapted to be connected to the negative pressure supply device and the other end fluidly connected to the recesses formed in the carrier body surface.

10. A polishing apparatus as set forth in claim 4 in which the carrier body has a circumferential surface extending from the carrier body surface at a predetermined angle in a direction away from the polishing surface and the circumferential surface is provided with a passage having one end adapted to be connected to the negative pressure supply device and the other end fluidly connected to the recesses formed in the carrier body surface.

* * * * *